US005704177A

United States Patent [19]

Wirkus et al.

[11] Patent Number: 5,704,177

[45] Date of Patent: Jan. 6, 1998

[54] SEPARATION MEANS FOR GLASS BLOCK WALL

[76] Inventors: Randolf Andrew Wirkus; Michelle Wirkus, both of 32 Norm Street, Kenmore, Queensland, 4069, Australia

[21] Appl. No.: 590,734

[22] Filed: Jan. 24, 1996

[30] Foreign Application Priority Data

Jan. 24, 1995 [AU] Australia ..... PN0721

[51] Int. Cl.[6] ..... E04C 1/42; E04B 2/20

[52] U.S. Cl. ..... 52/308; 52/306; 52/396.08; 52/562; 52/307; 446/111

[58] Field of Search ..... 52/306, 307, 308, 52/396.08, 396.09, 562, 564, 567, 568; 446/111, 113

[56] References Cited

U.S. PATENT DOCUMENTS

| | | | |
|---|---|---|---|
| 1,617,527 | 2/1927 | Knight | 52/586.2 |
| 2,141,000 | 12/1938 | Hohl | 52/308 |
| 2,239,537 | 4/1941 | Owen | 52/308 |
| 2,281,072 | 4/1942 | Knudsen | 52/307 |
| 4,774,793 | 10/1988 | Mayer | 52/306 X |
| 4,899,512 | 2/1990 | DeGooyer | 52/396.08 |
| 4,965,975 | 10/1990 | Schwarz | 52/308 |
| 5,031,372 | 7/1991 | McCluer | 52/307 |
| 5,259,161 | 11/1993 | Carter | 52/307 |
| 5,430,985 | 7/1995 | Coleman | 52/308 |

FOREIGN PATENT DOCUMENTS

| | | | |
|---|---|---|---|
| 2144196 | 2/1985 | United Kingdom | 403/231 |
| WO 95/05510 | 2/1995 | WIPO | 52/306 |

*Primary Examiner*—Carl D. Friedman
*Assistant Examiner*—Laura A. Saladino
*Attorney, Agent, or Firm*—Helfgott & Karas, P.C.

[57] ABSTRACT

A glass block wall 10 having a curved section 11 between a straight block 12 and a straight bull nosed end block 13 employs a lower run of blocks 14 and an upper run of blocks 15 shown in phantom to expose an arrangement 16 of separation means between the runs of blocks. The curved section 11 includes a number of curved separation plates 19, 20 and 21 each formed to the shape of an upper end face of the respective blocks. A corner block 22 has a corresponding plate 21 whereas the plates 19 and 20 are formed to the shape of bend blocks 23 and 24, forming a compound curve in the curved section 11.

19 Claims, 4 Drawing Sheets

SEPARATION MEANS FOR GLASS BLOCK WALL

TECHNICAL FIELD OF THE INVENTION

This invention relates to the construction of block walls and in particular but not limited to non-straight glass block walls.

BACKGROUND ART

Glass blocks are usually formed from welded together dish-like sections so that the finished block has opposed spaced side faces, each side face having a projecting peripheral edge and there being a peripheral channel surrounding the block between the edges of the side faces. In the finished wall grouting or other filler is located between the edges of the side faces of adjacent glass blocks. Square blocks are available for forming straight walls and curved blocks are also available so that more complex curved shapes can be made.

As the blocks are stacked to form a wall the channels of adjacent blocks are placed in confronting relation and various means are used to locate blocks in predetermined spaced relationship. In some arrangements straight separation strips of metal or plastics framing are used in the channels between the blocks to properly space, align the blocks and also provide added support for the wall.

Present systems employing strips of this kind are not suitable for non-straight walls.

it is an object of the present invention to alleviate this problem.

OUTLINE OF THE INVENTION

In one aspect therefore the present invention resides in a glass block wail separation means adapted to be positioned between non-straight glass blocks in a glass block wall, the separation means being formed to locate in an end wall of said non-straight glass blocks and being adapted to fit between the blocks and locate the blocks in predetermined spaced relation, the separation means having connector means at opposite ends thereof, the connector means being adapted to connect the separation means to another similar separation means or to a straight separation strip.

The separation means typically has a channel locating means which preferably comprises edge locating means to operatively locate edges of the separation means relative to the channel of the non-straight glass block.

The separation means is typically a flat member and can be plate-like. The edge locating means are typically spaced edge tabs displaced out of the plane of the plate to locate in the channel.

The separation means preferably includes adjustment means to enable the separation means or parts thereof to be displaced to bring about adjustment of spacing between the blocks. The adjustment means typically comprises edge tabs projecting onto opposed projecting peripheral edges of opposed glass blocks to provide leverable level adjustment tabs so that the tabs can be manually raised or lowered to adjust the spacing between the glass blocks at the point of tab contact with the projecting peripheral portion of the glass blocks.

In the case of the locating tabs and the level adjustment tabs the tabs are preferably staggered at spaced locations about the edge of the separation means.

The connector means typically comprises male/female type connectors, typically various types of connectors are employed for different geometries and to cater for different non-straight arrangements of glass blocks. One typical connector comprises a straight line connector enabling connection of a non-straight block to a straight block. Another connector, an angle type connector, is employed to connect a non-straight separation means at a predetermined angle. A further connector comprises a hinge type connector which allows pivotable movement, usually limited pivotable movement for connection to a non-straight separation means.

The connectors of the separation means are all preferably female type connectors co-operating with back-to-back male connectors bridging across between adjacent blocks in the finished wall.

The separation means and male connectors are typically thin sheet metal stampings with the male connectors having a gap bridging narrow neck portion between opposite head ends, each head end having a surrounding upstanding rim, the female connector of the separation means being shaped to co-operate with the head end, the rim being sized to allow transverse movement or separation of the connectors but to inhibit longitudinal displacement in planes parallel to and closely adjacent to the plane of the plate.

BRIEF DESCRIPTION OF THE DRAWINGS

In order that the present invention can be more readily understood and be put into practical effect reference will now be made to the accompanying drawings which illustrate the preferred embodiments of the invention and wherein.

METHOD OF PERFORMANCE

Figure 1:
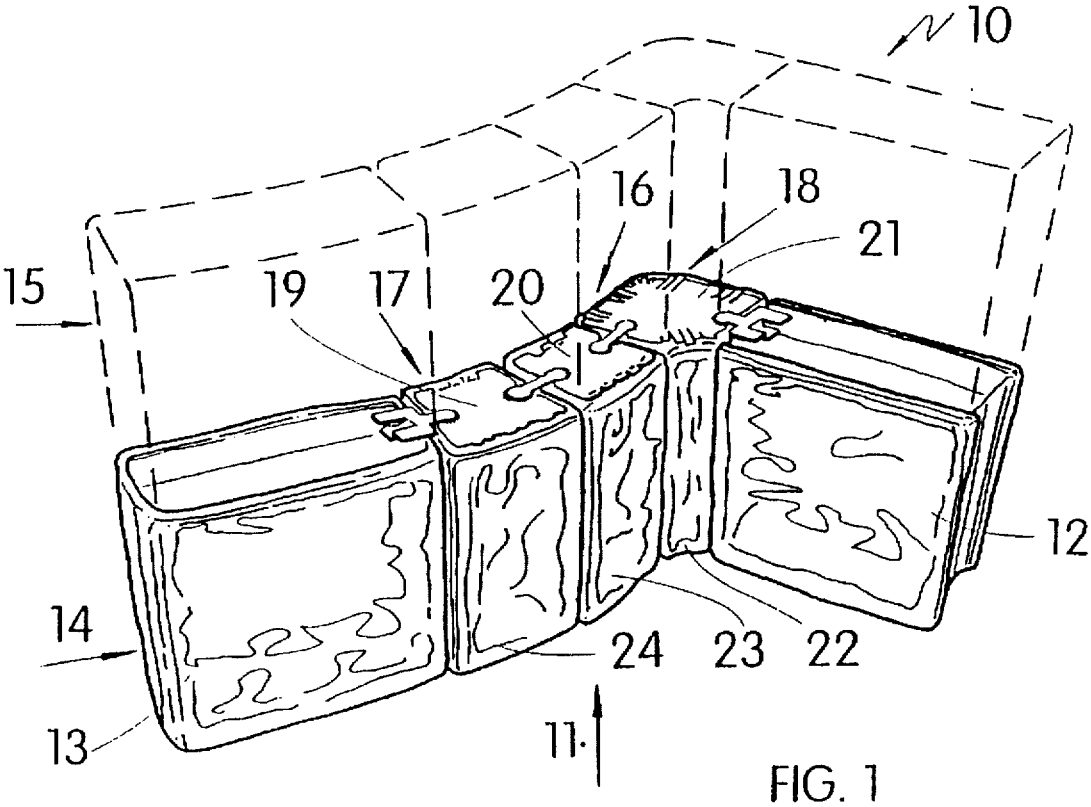
FIG. 1 is a perspective view of a typical non-straight glass block wall employing separation means according to the present invention.

Referring to the drawings and initially to FIG. 1 there is illustrated portion of a glass block wall 10 having a curved section 11 between a straight block 12 and a straight bull nosed end block 13. A lower run of blocks 14 are shown in solid outline and an upper run of blocks 15 are shown in phantom to expose an arrangement 16 of separation means between the runs of blocks.

The curved section 11 includes a number of curved separation plates 19, 20 and 21 each formed to the shape of an upper end face of the respective blocks. A corner block 22 has a corresponding plate 21 whereas the plates 19 and 20 are formed to the shape of bend blocks 23 and 24, forming a compound curve in the curved section 11.

In the illustrated embodiment two different separation plates are employed these being plates 19 and 20 which are the same and plate 21.

Figure 2:
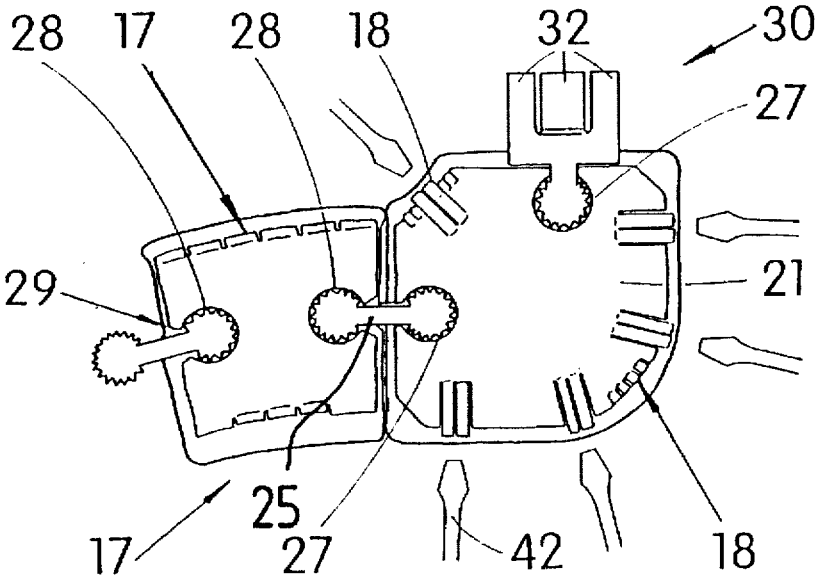
FIG. 2 is a plan view of two non-straight blocks showing typical application of the present invention.

The plates 20 and 21 are shown in plan view in FIG. 2 and are held together by a back-to-back male connector 25 bridging across the gap 26 between the glass blocks 22 and 23 (the blocks having been reversed for purposes of illustration). The plate 21 has female connectors 27 at each end thereof adapted to locate a connector as shown in straight line relationship while the plate 20 includes female connectors 28 which have a mouth 29 allowing limited pivotable movement of the plate 20 relative to the male connectors. This assists in minor adjustments to alignment of the glass block 23 relative to the glass block 22.

The straight line connector 30 includes a head end 31 and a plurality of fingers 32 so that the fingers 32 adapt to project into position inside or around a straight separation strip. This is illustrated in FIG. 1.

As can also be seen in FIG. 2 the edges of the plates 20 and 21 include staggered tabs at 17 and 18 displaced out of the plane of the plates 20 and 21 to locate the plates in channels within the glass blocks. This will be described in more detail below in relation to FIGS. 3 and 4.

Figure 3:
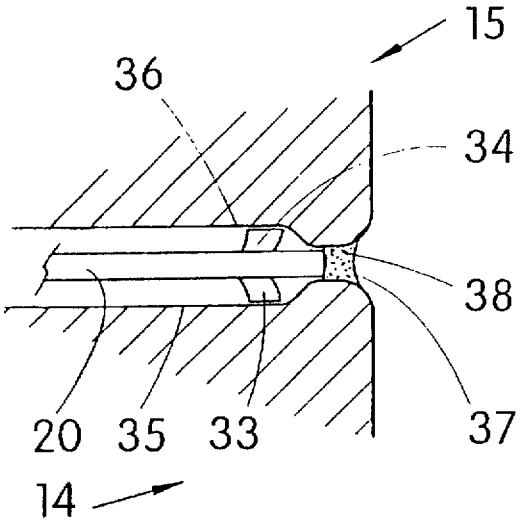
FIG. 3 is a section showing edge tabs locating a typical separation means relative to upper and lower glass blocks.

Referring now to FIG. 3 there is illustrated locating tabs 17 which are typically shown offset and staggered at 33 and 34 and locating against the inside channel sections 35 and 36 of the adjacent glass blocks. The space between projecting edge portions 37 and 38 is filled with a grouting or other filler 39 as shown.

Figure 4:
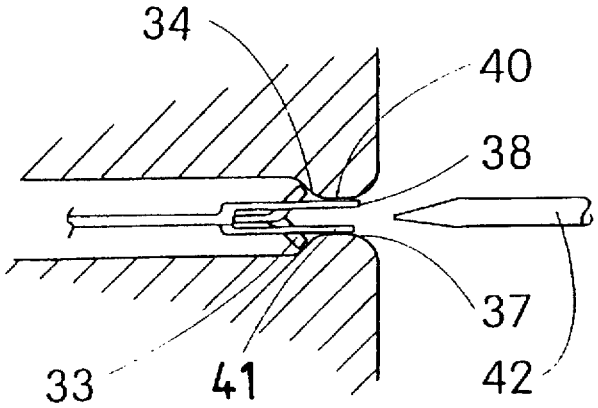
FIG. 4 is a view similar to FIG. 3 but in this case showing edge tabs employed as adjustment means.

Referring now to FIG. 4 as illustrated, adjustment tabs 40 and 41 extend outwardly of the tabs 33 and 34 to engage the edge portions 37 and 38 and a tool such as the screw driver 42 can be inserted into the gap between the tabs 40 and 41 and the tabs can be separated in order to adjust the spacing between the glass blocks. Once the glass blocks are in their desired position the tabs settings can be retained.

Figure 5:
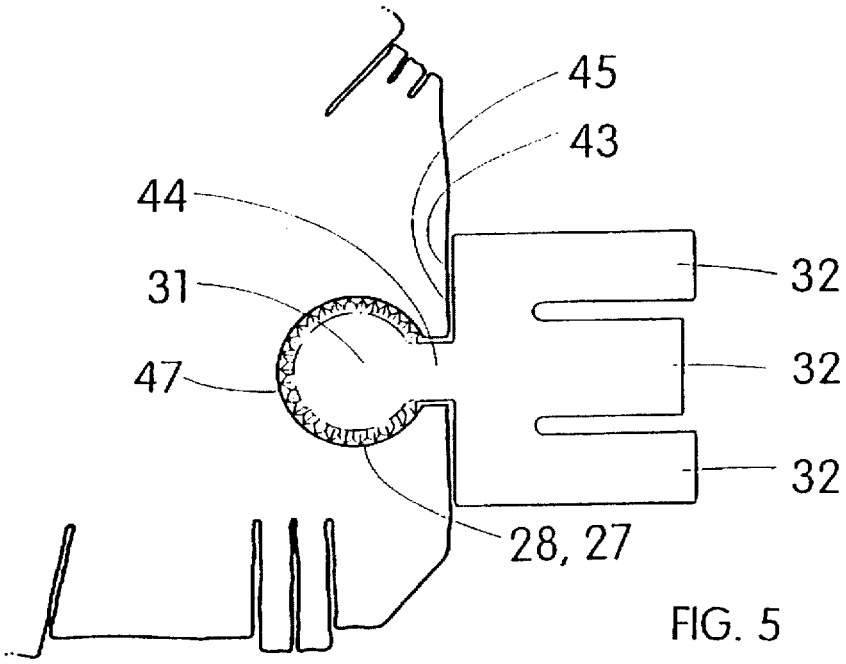
FIGS. 5 and 6 are plan views illustrating typical connectors.
Figure 6:
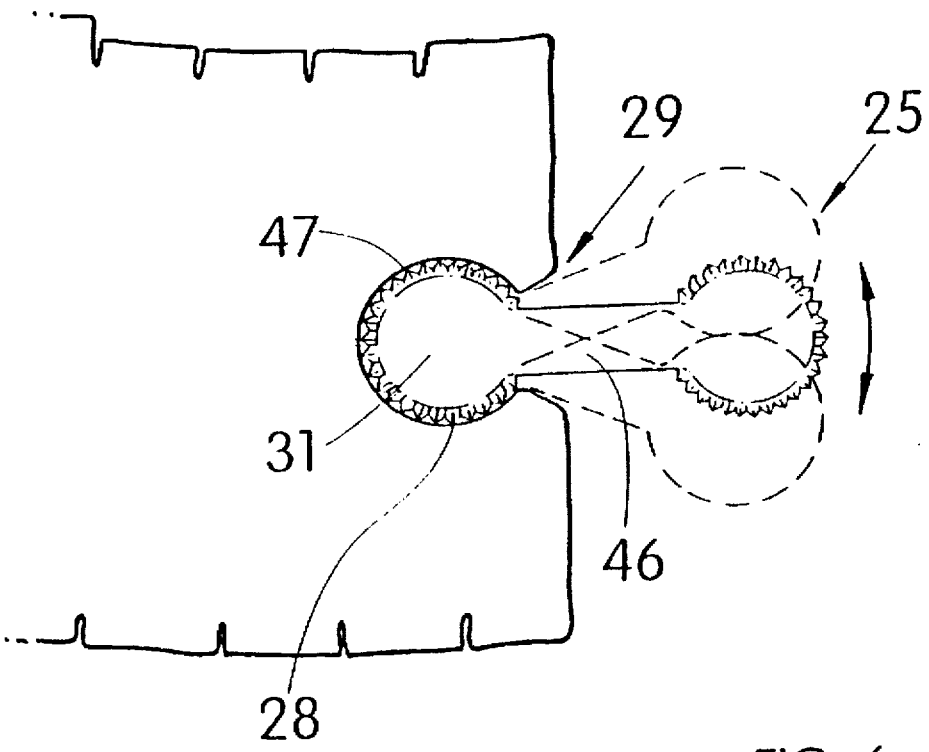
Figure 7:
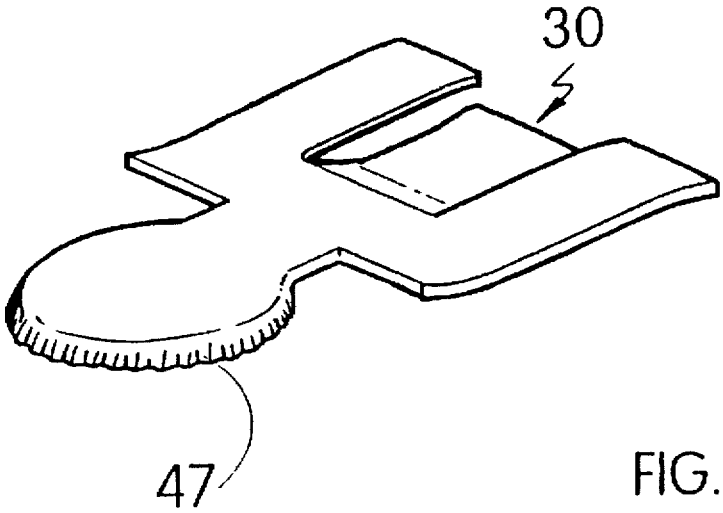
FIG. 7 is a perspective view of a straight-line male connector.

Referring now to FIGS. 5, 6 and 7 there is illustrated now in more detail the male connectors 25 and 30. As can be seen the male connector 30 has shoulders 43 set at 90 degrees to the neck section 44 and these engage with edge portions 45 of the plate 21 so that the connector fingers 32 are automatically aligned to give a straight line connection with a straight separation strip. In FIG. 6 the connector 25 is disposed for limited pivotable movement due to the configuration of the mouth 29 into the female connector whereby the neck 46 is allowed to pivot in this case up to 22 degrees between the positions illustrated in phantom so that there can be limited pivotable movement of the associated blocks during assembly.

FIG. 7 illustrates how the heads of the male connectors are formed from a thin metal stamping, the heads all having a projecting rim 47 providing a total thickness of about 3 mm. This enables and ensures that the head is retained against longitudinal movement in the direction of the block runs once the separations strips are installed between the glass blocks.

In the illustrated embodiment straight line separation strips give rise to a 3 mm separation between the edge portions 37 and 38 of the side faces of blocks in adjacent runs. For this reason the 3 mm is selected for the normal adjustment of the tabs 40 and 41 and also the 3 mm thickness afforded by the rim 47 in the heads of each of the male connectors.

Figure 8:
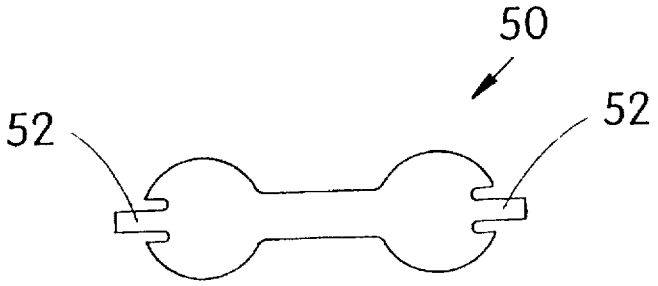
FIGS. 8 to 10 illustrate alternative embodiments of connectors suitable for use with the present invention.
Figure 9:
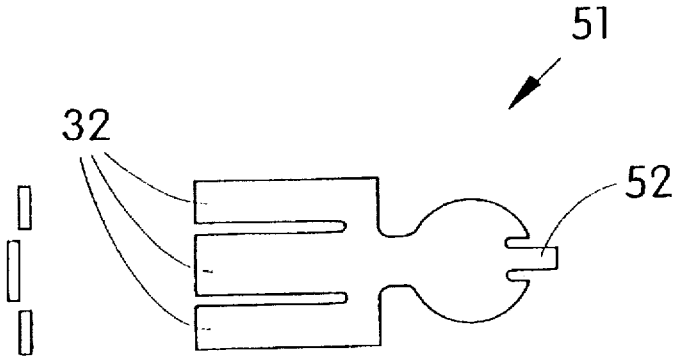
Figure 10:
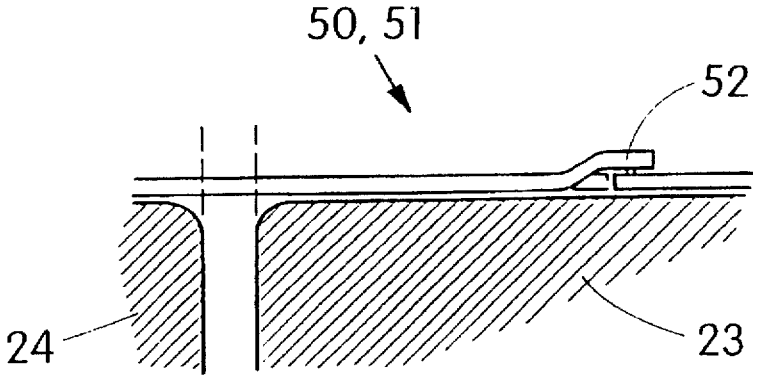

Referring to FIGS. 8 to 10, there is illustrated further embodiments of connectors. The connectors 50 and 51 employ a raised projecting finger 52 which is adapted to rest on top of an adjacent separation means as can be seen in FIG. 10. The finger 51 holds the connector and separation means in alignment.

Whilst the above has been given by way of illustrative example of the present invention, many variations and modifications thereto will be apparent to those skilled in the art without departing from the broad ambit and scope of the invention as set forth in the appended claims.

We claim:

1. A glass block wall comprising:

straight and non-straight glass blocks, so the wall has a non-straight section, the glass blocks having opposed side walls and end walls, the end walls of adjacent blocks being placed in confronting relation so the glass blocks are arranged in horizontal runs, separation means positioned between the horizontal runs of glass blocks, the separation means being formed to locate between the confronting end walls of said glass blocks and being adapted to fit between the blocks and locate the blocks in a predetermined spaced relation, each separation means including a plurality of connected together sections, each section having opposite ends and opposite side edges, at least some of said sections being connected together by said connector means so that said sections of said separation means are offset forming the non-straight section of said glass block wall.

2. The glass block wall according to claim 1 wherein each glass block has a channel defined by opposed projecting peripheral edges formed in its end walls and each section of the separation means has channel locating means along its edges comprising means operatively locating the edges of the sections of the separation means in the channels in the end walls of the glass blocks.

3. The glass block wall according to claim 2 wherein the sections of the separation means are plates and the means locating the edges of the sections are spaced edge tabs displaced out of the plane of the plates to locate the plates in the channels.

4. The glass block wall according to claim 3 wherein the connector means hold the sections together and comprises separate connectors selected from the following:

(i) A straight line connector connecting a section of the separation means that is between said non-straight blocks to a section of the separation means that is between adjacent said straight blocks;

(ii) An angle type connector employed to connect a said section of the separation means at a predetermined set inclination relative to an adjacent said section of the separation means; or (iii) A hinge type connector which allows pivotal movement between adjacent said sections of the separation means.

5. The glass block wall according to claim 3 wherein the connector means includes separate connectors that hold the sections of the separation means together, each connector being a thin metal sheet stamping with at least one male end, the sections of the separation means having a female receiver retaining the male end of the connector, the male end having a region displaced out of the plane of the connector employed to aid alignment of the connector with the receiver.

6. The glass block wall according to claim 2 wherein the separation means includes adjustment means to enable the edges of the sections of the separation means to be displaced to bring about adjustment of spacing between the end walls of the glass blocks.

7. The glass block wall according to claim 6 wherein the adjustment means comprises edge tabs projecting from the edges of each section of the separation means onto the projecting peripheral edges of the glass blocks to provide leverable level adjustment tabs so that during assembly of the glass block wall the tabs can be manually raised or lowered to adjust the spacing between the glass blocks at points of tab contact with the projecting peripheral edges of the glass blocks.

8. The glass block wall according to claim 7 wherein the connector means hold the sections together and comprises separate connectors selected from the following:

(i) A straight line connector connecting a section of the separation means that is between said non-straight blocks to a section of the separation means that is between adjacent said straight blocks;

(ii) An angle type connector employed to connect a said section of the separation means at a predetermined angle relative to an adjacent said section of the separation means; or (iii) A hinge type connector which allows pivotal movement between adjacent said sections of the separation means.

9. The glass block wall according to claim 7 wherein the connector means includes separate connectors that hold the sections of the separation means together, each connector being a thin metal sheet stamping with at least one male end, the sections of the separation means having a female receiver retaining the male end of the connector, the male end having a region displaced out of the plane of the connector employed to aid alignment of the connector with the receiver.

10. The glass block wall according to claim 6 wherein the connector means hold the sections together and comprises separate connectors selected from the following:

(i) A straight line connector connecting a section of the separation means that is between said non-straight blocks to a section of the separation means that is between adjacent said straight blocks;

(ii) An angle type connector employed to connect a said section of the separation means at a predetermined set inclination relative to an adjacent said section of the separation means; or (iii) A hinge type connector which allows pivotal movement between adjacent said sections of the separation means.

11. The glass block wall according to claim 6 wherein the connector means includes separate connectors that hold the sections of the separation means together, each connector being a thin metal sheet stamping with at least one male end, the sections of the separation means having a female receiver retaining the male end of the connector, the male end having a region displaced out of the plane of the connector employed to aid alignment of the connector with the receiver.

12. The glass block wall according to claim 2 wherein the connector means hold the sections together and comprises separate connectors selected from the following:

(i) A straight line connector connecting a section of the separation means that is between said non-straight blocks to a section of the separation means that is between adjacent said straight blocks;

(ii) An angle type connector employed to connect a said section of the separation means at a predetermined set inclination relative to an adjacent said section of the separation means; or (iii) A hinge type connector which allows pivotal movement between adjacent said sections of the separation means.

13. The glass block wall according to claim 12 wherein the connector means includes separate connectors that hold the sections of the separation means together, each connector being a thin metal sheet stamping with at least one male end, the sections of the separation means having a female receiver retaining the male end of the connector, the male end having a region displaced out of the plane of the connector employed to aid alignment of the connector with the receiver.

14. The glass block wall according to claim 1 wherein the separation means includes adjustment means to enable the edges of the sections of the separation means to be displaced to bring about adjustment of spacing between the end walls of the glass blocks.

15. The glass block wall according to claim 14 wherein the connector means hold the sections together and comprises separate connectors selected from the following:

(i) A straight line connector connecting a section of the separation means that is between said non-straight blocks to a section of the separation means that is between adjacent said straight blocks;

(ii) An angle type connector employed to connect a said section of the separation means at a predetermined set inclination relative to an adjacent said section of the separation means; or (iii) A hinge type connector which allows pivotal movement between adjacent said sections of the separation means.

16. The glass block wall according to claim 14 wherein the connector means includes separate connectors that hold the sections of the separation means together, each connector being a thin metal sheet stamping with at least one male end, the sections of the separation means having a female receiver retaining the male end of the connector, the male end having a region displaced out of the plane of the connector employed to aid alignment of the connector with the receiver.

17. The glass block wall according to claim 1 wherein the connector means hold the sections together and comprises separate connectors selected from the following:

(i) A straight line connector connecting a section of the separation means that is between said non-straight blocks to a section of the separation means that is between adjacent said straight blocks;

(ii) An angle type connector employed to connect a said section of the separation means at a predetermined set inclination relative to an adjacent said section of the separation means; or (iii) A hinge type connector which allows pivotal movement between adjacent said sections of the separation means.

18. The glass block wall according to claim 17 wherein the connector means includes separate connectors that hold the sections of the separation means together, each connector being a thin metal sheet stamping with at least one male end, the sections of the separation means having a female receiver retaining the male end of the connector, the male end having a region displaced out of the plane of the connector employed to aid alignment of the connector with the receiver.

19. The glass block wall according to claim 1 wherein the connector means includes separate connectors that hold the sections of the separation means together, each connector being a thin sheet metal stamping with at least one male end, the sections of the separation means having a female receiver retaining the male end of the connector, the male end having a region displaced out of the plane of the connector employed to aid alignment of the connector with the receiver.

* * * * *